United States Patent [19]

Alfano

[11] Patent Number: 4,682,020

[45] Date of Patent: Jul. 21, 1987

[54] PICOSECOND GATED LIGHT DETECTOR

[76] Inventor: Robert R. Alfano, 3777 Independence Ave., Bronx, N.Y. 10463

[21] Appl. No.: 585,214

[22] Filed: Mar. 1, 1984

[51] Int. Cl.[4] ..... H01J 31/50

[52] U.S. Cl. ..... 250/213 VT; 313/537

[58] Field of Search ..... 250/207, 213 VT; 313/523, 529, 537

[56] References Cited

U.S. PATENT DOCUMENTS

| | | | |
|---|---|---|---|
| 3,969,699 | 7/1976 | McGlaughlin | 250/207 |
| 4,069,418 | 1/1978 | Merkelo | 250/207 |
| 4,272,782 | 6/1981 | Proper et al. | 250/213 VT |
| 4,352,127 | 9/1982 | Tsuchiya | 250/213 VT |
| 4,413,178 | 11/1983 | Mourou et al. | 313/537 |
| 4,437,763 | 3/1984 | Kaye | 250/207 |

*Primary Examiner*—David C. Nelms

*Attorney, Agent, or Firm*—Irving M. Kriegsman

[57] ABSTRACT

A light detector which can be gated on and off in picoseconds is disclosed. The light detector includes a photomultiplier tube and a streak camera, the streak camera having a picosecond sweep time and being disposed so as to serve as a gate for the input to the photomultiplier tube. In operation, light received by the streak camera is converted into a streak image which is formed on the phosphor screen of the streak camera tube, the streak image corresponding to the intensity of light received by the streak camera during the time window of the sweep. Relay optics at the output end of the streak camera images the streak image onto the photocathode of the photomultiplier tube. The input end of the streak camera includes a two lens relay lens system. A variable aperture located between the phosphor screen and the output relay optics limits the portion of the streak image that is collected by the output relay optics and actually imaged onto the photomultiplier tube and hence the portion of the time window during which the photomultiplier tube receives light from the streak camera. A varible delay unit coupled to input of the streak camera enables the time window to be selectively shifted.

8 Claims, 2 Drawing Figures

PICOSECOND GATED LIGHT DETECTOR

BACKGROUND OF THE INVENTION

The present invention relates to light detectors and more particularly to a light detector having an ultrafast gated input.

There is a need for a light detector having an input that can be gated on an off over an ultrashort time window, such as in picoseconds. For example, it is well known that Raman scattering signals produced when a sample is excited by a light source respond instantaneously following the shape of the impinging light signal, which may be a pulse on the order of picoseconds, while the fluorescence emission times are generally greater than a few nanoseconds. In order to measure the intensity of the Raman signals it would therefore be desirable to provide a light detector that can be gated on and off for a time period that is not longer than the excitation pulse.

Photomultiplier tubes are well known in the art and commonly used as light detectors to measure the intensity of light impinging thereon.

Streak cameras are about ten years old in the art and have been used, hitherto, to directly measure the time dynamics of luminous events, that is to time resolve a light signal. A typical streak camera includes an entrance slit which is usually rectangular, a streak camera tube, input relay optics for imaging the entrance slit into the streak camera tube, appropriate sweep generating electronics and output relay optics for imaging the streak image formed at the output end of the streak camera tube onto an external focal plane. The image at the external focal plane is then either photographed by a conventional still camera or a television camera. The streak camera tube generally includes a photocathode screen, an accellerating mesh, sweeping electrodes and an phosphor screen. The streak camera tube may also include a microchannel plate. Light incident on the entrance of the streak camera is converted into a streak image which is formed on the phosphor screen, with the intensity of the streak image from the start of the streak to the end of the streak corresponding to the intensity of the light incident thereof during the time window of the streak. In the past, the input optics of the streak camera has been a single lens.

In an article entitled "An Ultrafast Streak Camera System" by N. H. Schiller, Y. Tsuchiya, E. Inuzuka, Y. Suzuki, K. Kinoshita, K. Kamiya, H. Iida and R. Alfano appearing in the June 1980 Edition of Optical Spectra, various known streak camera systems are discussed. The article is incorporated herein by reference.

In U.S. Pat. No. 4,232,333 to T. Hiruma et al there is disclosed a streak image analyzing device in which the output streak image of a streak camera is fed into a television camera. The output of the television camera is fed through a video-mixing circuit to a monitor. The output of the television camera is also fed to an integrating circuit through a gate circuit. The output of the integrating circuit is fed to a memory through an analog to digital converter. The output of the memory is displayed by a display unit and/or fed back into the video-mixing circuit.

In an article entitled Picosecond Characteristics Of A Spectrograph Measured By A Streak Camera/Video Readout System by N. H. Schiller and R. R. Alfano appearing in the December 1980 issue of Optical Communications, Volume 35, No. 3. pp. 451–454 a streak camera/video readout system is disclosed. The article is incorporated herein by reference. Another article pertaining to streak cameras and spectrographs is Coupling An Ultraviolet Spectrograph To A SC/OMA For Three Dimensional Picosecond Fluorescent Measurements by C. W. Robinson et al in Multichannel Image Detectors pp. 199–213. ACS Symposium Series 102, American Chemical Society.

Known patents of interest include U.S. Pat. No. 2,823,577 to R. C. Machler; U. S. Pat. No. 3,385,160 to J. B. Dawson et al; U.S. Pat. No. 2,436,104 to A. W. Fisher et al; U. S. Pat. No. 3,765,769 to E. B. Treacy; U. S. Pat. No. 4,060,327 to Jacobowitz et al; U. S. Pat. No. 4,162,851 to A. Wade; U. S. Pat. No. 4,299,488 to W. J. Tomlinson and U. S. Pat. No. 4,320,971 to N. Hashimato et al.

It is the general purpose of this invention to provide a device in which a streak camera is used not for the purpose of time resolving a light signal but rather as a gate for gating the input to a photomultiplier tube over an ultrashort time window.

Accordingly, it is an object of this invention to provide a new and improved light detector.

It is another object of this invention to provide a light detector having an input that can be gated on and off in picoseconds.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

SUMMARY OF THE INVENTION

A light detector constructed according to the teachings of the present invention comprises a photomultiplier tube for receiving light and producing an analog electrical output signal corresponding to the intensity of the light incident thereon and a streak camera for gating the light incident on the photomultiplier tube over a time window corresponding to the time during which the streak image is formed, or a discrete portion thereof.

In order that the invention may be more fully understood, it will now be described, by way of example, with reference to the accompanying drawing in which like reference numerals or characters represent like parts.

BRIEF DESCRIPTION OF THE DRAWINGS

In the drawings wherein like reference numerals represent like parts.

DETAILED DESCRIPTION OF PREFERRED EMBODIMENTS

The present invention is directed to a novel light detector which includes a photomultiplier tube whose input is gated over an ultrafast time window by means of a streak camera.

Figure 1:
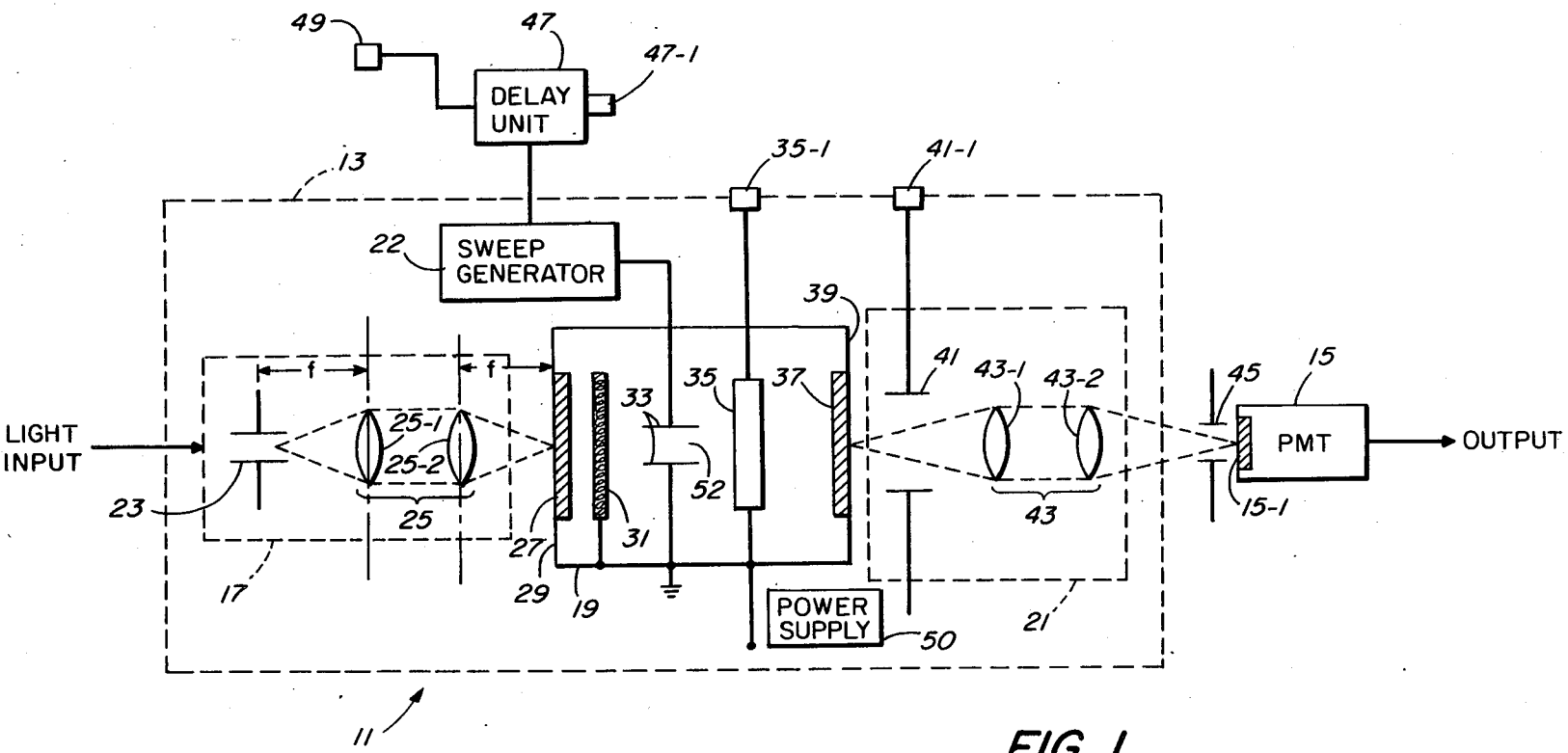
FIG. 1 is a diagram of a light detector constructed according to the teachings of the present invention.

Referring now to the drawings, there is illustrated in FIG. 1 a diagram of a picosecond gated light detector constructed according to the teachings of the present invention and identified generally by reference numeral 11.

Picosecond gated light detector 11 includes a streak camera 13 and a photomultiplier tube 15. Streak camera 13 forms a streak image of light received over a time window corresponding to the time during which the streak image is formed and serves as an input gate for photomultiplier tube 15. Photomultiplier tube 15 measures the intensity of light incident thereon from streak camera 13.

Streak camera 13 includes an input section 17, a streak camera tube 19, an output section 21 and a sweep generator 22.

Input section 17 includes an input slit 23 and an input relay lens system 25. Input relay lens system 25 includes a first lens 25-1 for collecting light at input slit 23 and a second lens 25-2 for bringing the light collected by first lens 25-1 to focus on streak camera tube 19. Lens 25-1 is spaced from input slit 23 at a distance equal to its focal length and lens 25-2 is spaced from streak camera tube 19 a distance equal to its focal length. By using two lenses as shown, rather than a single lens spaced at a distance equal to twice its focal length from input slit 23 and also from streak camera tube 19, four times as much light can be collected giving an improved light energy collection efficiency of over 400% as compared to a single F-1 lens. Input slit 23 is rectangular in shape but maybe a pin hole or any other shape which produces a point source.

Streak camera tube 19 includes a photocathode 27 at the input end 29, an accelerating mesh 31, a pair of sweeping electrodes 33, a microchannel plate 35 whose imput voltage is controllable by a knob 35-1 and a phosphor screen 37 at the output end 39.

Output section 21 includes a variable aperture 41 whose size may be regulated by a control knob 41-1 and an output relay lens system 43 made up of a first lens 43-1 and a second lens 43-2. Output relay lens system 43 images the streak image formed on phosphor screen 37 of the streak camera tube 19 onto the photocathode 15-1 of photomultiplier tube 15. Variable aperature 41 limits the portion of the streak image on phosphor screen 37 that is actually collected by output relay lens system 43. The photomultiplier 15 receives a conventional bias voltage from a power source which may be external or within streak camera 13.

Sweep generator 22 may either be an Avalanche type circuit (single shot, which may provide a signal up to around 1000 HZ) or a syn-sine type drive circuit which may provide signals from 50 MHZ to 200 MHZ.

Light detector 11 also includes an aperture 45 in front of photomultiplier tube 15 which serves to prevent stray light from entering photomultiplier tube 15. The trigger signal to sweep generator 22 is obtained from a variable delay unit 47 controlled by a knob 47-1 which is coupled between a trigger signal device 49 and sweep generator 22. Variable delay unit delays the arrival of the trigger signal to the sweep generator 22.

Streak camera 13 also includes a power supply 50 for providing appropriate voltage signals to power streak camera 13. Power supply 50 is connected to an external power source (not shown).

In the operation of streak camera 13, light received at input slit 23 is imaged by input relay lens system 17 onto photocathode 27. Light striking photocathode 27 produces emission of electrons in proportion to the intensity of the incident light. The electrons are conducted by accellerating mesh 31 into a deflection field 52 in streak camera tube 19 where they are electrostatically swept transversly across streak camera tube 13 by sweeping electrodes 33 at a velocity determined by sweep generator 22. The swept electrons strike microchannel plate 35 which produces electron multiplication through secondary emission. The secondary electrons released at different times in relation to the incident electrons impinge on phosphor screen 37 to form a streak image of defined size. Output relay lens system 43 images the streak image formed on phosphor screen 37 onto the photocathode of photomultiplier 15. Variable aperture 41, whose size is controllably adjusted by a control unit 41-1, limits the portion of the streak image formed on phosphor screen 37 that is collected by relay lens system 43 and imaged onto photomultiplier tube 15.

The time window of the streak image formed on the phosphor screen 37 streak camera tube depends on the time it takes to make a complete sweep. This, in turn, depends on the sweep rate of sweep generator 22 and the angular distance over which a complete sweep is made. For example, if the sweep generator produces a sweep rate of 25 picoseconds per millimeter and the height of the streak image (from start to end) is 15 millimeters then the time window (resulting from one complete sweep) is 375 picoseconds. Thus, the time window produced by streak camera 13 with variable aperture 41 fully opened will be 375 picoseconds. However, by reducing the opening of variable aperture 41, the portion of the streak image that is actually collected by output relay optics 43 from phosphor screen 37 will be proportionally reduced, causing light corresponding to only a fraction of the time window to be actually received by photomultiplier tube 15. For example, if the size of the streak image on phosphor screen 37 is 15 millimeters and the size of the opening of variable aperture 41 is reduced to 7.5 millimeters, only one half of the light of the streak image will be collected by relay optics 43, i.e. light over only one half of the time window. Similarly if the aperture size of variable aperture 41 is one tenth of the size of the streak image on phosphor screen 37 then only light during one tenth of the time window will be received by photomultiplier tube 15, (from camera 13). Thus, even though the streak tube 19 portion of streak camera 13 produces a time window of 375 picoseconds, the time window during which photomultiplier tube 15 actually receives light will only be 37.5 picoseconds.

Streak tube 19 may be a model N895 streak tube manufactured by Hamamatsu TV co. Ltd. of Hamamatsu, Japan.

Delay unit may be for example a delay unit such as described in U.S. patent application Ser. No. 342,486, now, U.S. Pat. No. 4.439.416 or a programmable, stepped or continuously variable, pulse generator for 0–20,000 picoseconds.

Figure 2:
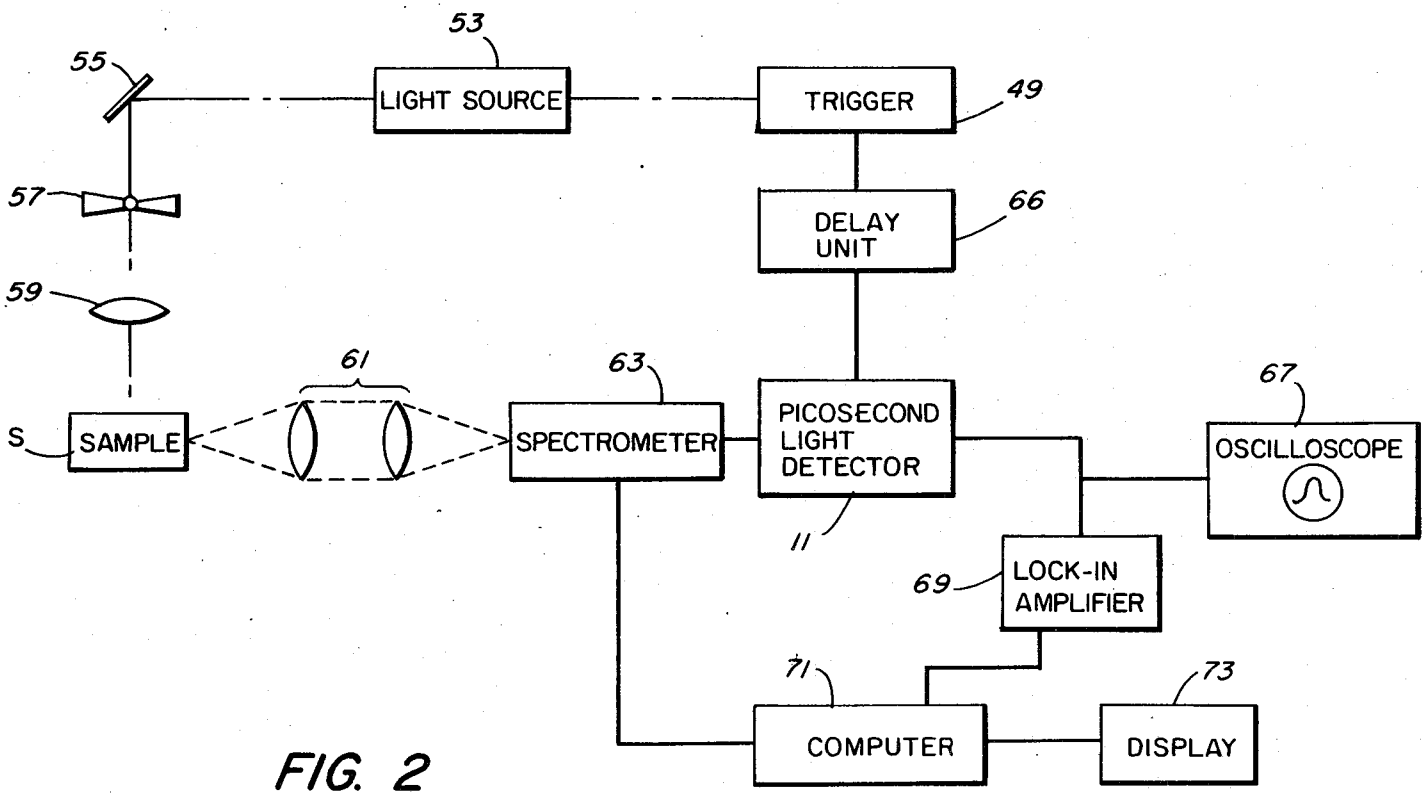
FIG. 2 is a diagram of an optical system including the light detector in FIG. 1.

Referring now to FIG. 2, there is illustrated a diagram of a system 51 for measuring the intensity of light outputted from a sample over a picosecond time window using picosecond light detector 11.

Light from a laser light source 53, which is a continuous wave picosecond laser, is deflected by a mirror 55, passed through a chopper 57 and brought to focus by a lens 59 on a sample S to be tested. Light outputted from sample S is collected and brought to focus by a relay lens system 61 at the input of a spectrometer 63. Light from the spectral region of interest from spectrometer 63 is passed into picosecond gated light detector 11 which measure the intensity of the light over a time window set by streak camera 13. The size of the gate window determines the time interval selected and displayed. Light from laser 53 is also used to provide a light signal for triggering trigger 49, which may be a photodiode. The trigger signal from trigger 49 is fed into the sweep generator in streak camera 13 of light detector 11 through delay unit 66 which may be the same as delay unit 47. Alternatively, delay unit 66 may be programmable and controlled by the computer hereinafter described over a line (not shown). The analog electrical output signal from picosecond gated light detector 11 is fed into an oscilloscope 67 where it is displayed and fed through a lock-in amplifier 69 to a computer 71 where it may be stored and/or displayed on the monitor 73. Computer 71 is also coupled to spectrometer 63 for controlling the spectral region of interest that is outputted from spectrometer 63 to picosecond light detector 11. This gives intensity vs. wavelength in a gated time window. If light source 53 is a single shot laser, chopper 57 is eliminated.

The time window or gate produced by streak camera 13 may be further increased in size by increasing the magnification of the image that is imaged by relay optics 43. For example, if the magnification produced by relay optics is simply 1 to 1 then the entire image on phosphor screen will be imaged onto photomultiplier tube 15. On the other hand, if the magnification is 1 to 4, then the image from phosphor screen 37 will be magnified by a factor of 4 and only one quarter of the image will be imaged onto the photomultiplier tube, reducing thereby the time window by a factor 4.

The components making up input section 17 may be housed in a suitable housing (not shown) which may be mechanically attached by any suitable means (not shown) to the first end of tube 19. The components making up output section 21 may also be similarly housed in a housing which may be attached to the rear end of tube 19.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A light detector having an ultrafast input gate for use in measuring the intensity of a light signal over an ultrashort time window, said light detector comprising:

a. a streak camera for receiving said light signal and producing a streak image of the light signal over an ultrashort time window, b. a photomultiplier tube for measuring the intensity of the light in at least a portion of the streak image produced by the streak camera and producing an analog electrical output signal corresponding to the intensity of the light so measured, c. said streak camera comprising:

i. a streak camera tube, said streak camera tube having an input end, an output end, a photocathode at the input end, a phosphor screen at the output end and a pair of sweeping electrodes between the input end and the output end, the streak image produced by the streak camera being formed on the phosphor screen ii. an input slit, iii. input relay optics for imaging the input slit onto the photocathode, iv. output relay optics for imaging the streak image formed on the phosphor screen onto the photomultiplier tube, v. a sweep generator for driving the sweeping electrodes, and vi. aperture means between the phosphor screen and the ouput relay optics for limiting the portion of the streak image formed on the phosphor screen that is collected by the relay lens and imaged onto the photomultiplier tube, and d. a delay unit coupled to the sweep generator for delaying the output signal of the sweep generator, e. the sweep generator together with the size of the streak image defining the size of the ultrashort time window.

2. The light detector of claim 1 and wherein the aperture between the phosphor screen and the output relay optics is variable so that the portion of the streak image that is imaged onto the photomultiplier tube may be varied.

3. The light detector of claim 2 and wherein the sweep generator is arranged to provide multiple selectable sweeping rates so as to produce multiple selectable sized time windows.

4. The light detector of claim 2 and wherein the sweep generator is arranged to provide a complete sweep over a time interval of either about 275 picoseconds, 500 picosecond, 1 nanosecond, 2 nanoseconds or 5 nanoseconds.

5. The light detector of claim 2 and wherein the aperture means between the phosphor screen and the output relay optics is designed to reduce the amount of the light that is imaged onto the photomultiplier tube from the streak camera by a factor of up to about 10.

6. The light detector of claim 5 and wherein the delay unit is variable, whereby the ultrashort time window can be shifted by varying amounts.

7. The light detector of claim 6 and further including an aperture between the streak camera and the photomultiplier tube to prevent stray light from entering the photomultiplier tube.

8. A method of measuring the intensity of a light signal over an ultrashort time window comprising:

a. providing a photomultiplier tube and a streak camera, the streak camera including a sweep generator for producing sweeping action of electrons at a defined sweeping rate, b. directing the ultrashort light signal into the streak camera, c. measuring the intensity of the streak image formed by the streak camera with the photomultiplier tube, and d. whereby the portion of the light signal applied to said photomultiplier tube will correspond to the time it takes the streak camera to make one sweep.

* * * * *